United States Patent [19]

Macuga et al.

[11] 4,126,971

[45] Nov. 28, 1978

[54] FIXTURE HANGING ASSEMBLY

[75] Inventors: Henry J. Macuga; Bernard F. Deschamps, both of Ware, Mass.

[73] Assignee: Eclipse Mfg. Inc., Ware, Mass.

[21] Appl. No.: 789,710

[22] Filed: Apr. 21, 1977

Related U.S. Application Data

[63] Continuation-in-part of Ser. No. 715,822, Aug. 19, 1976, which is a continuation-in-part of Ser. No. 455,575, Mar. 28, 1974, abandoned.

[51] Int. Cl.[2] ..... E04F 19/00

[52] U.S. Cl. ..... 52/28; 248/214; 248/DIG. 6

[58] Field of Search ..... 52/28; 248/27, 57, 201, 248/228, 72, 342, 343, 344, DIG. 6

[56] References Cited

U.S. PATENT DOCUMENTS

| | | | |
|---|---|---|---|
| 1,212,185 | 1/1917 | Cobb | 248/226.5 |
| 1,540,394 | 6/1925 | Hall et al. | 248/226.5 X |
| 2,729,414 | 1/1956 | Clark | 248/57 X |
| 2,930,564 | 3/1960 | Maier | 248/DIG. 6 |
| 2,962,252 | 11/1960 | Frank | 52/28 |
| 3,352,071 | 11/1967 | Sutter | 52/28 |
| 3,415,018 | 12/1968 | Sutter | 52/28 |
| 3,597,889 | 8/1971 | Lo Nigro | 52/28 |

*Primary Examiner*—William H. Schultz

*Attorney, Agent, or Firm*—Morgan, Finnegan, Pine, Foley & Lee

[57] ABSTRACT

An overhead ceiling structure with an integrated fixture hanging assembly, the fixture hanging assembly being supported by a yoke means bridging a pair of adjacent ceiling frame rail members and comprising improved clips or mounts adapted to permit the installation of a continuous row of fixtures.

15 Claims, 16 Drawing Figures

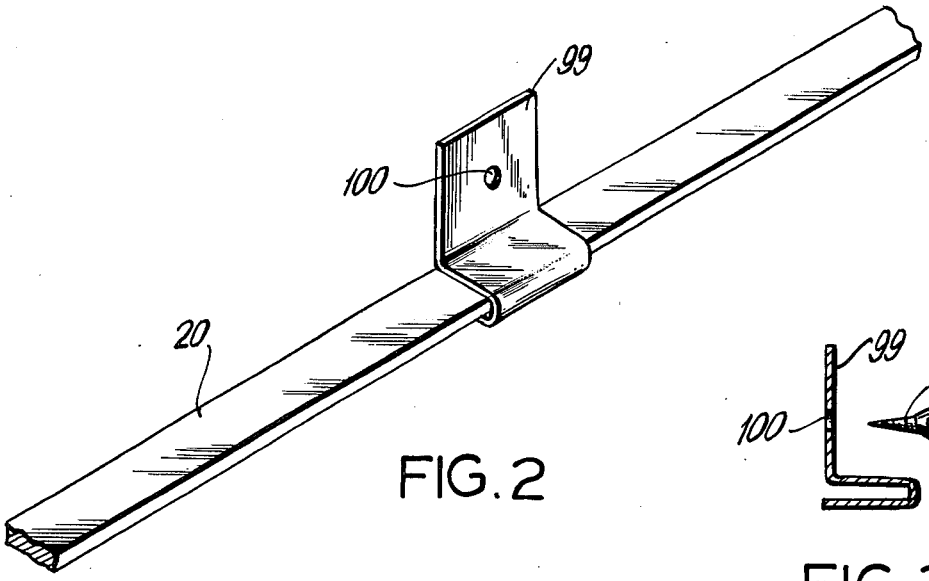
FIG. 2
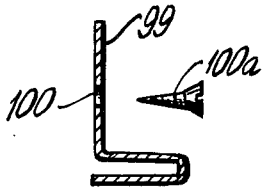
FIG. 3
FIG. 8
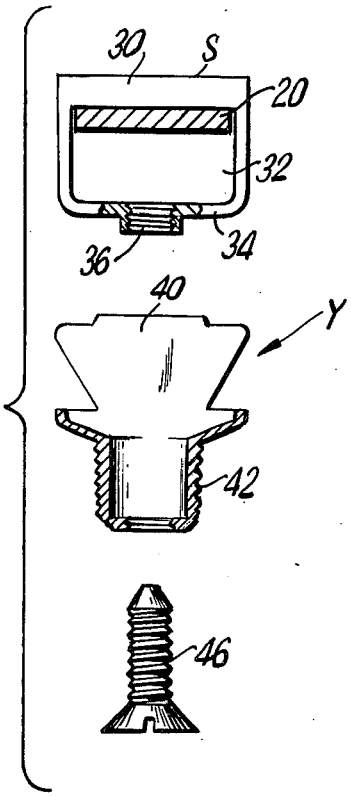
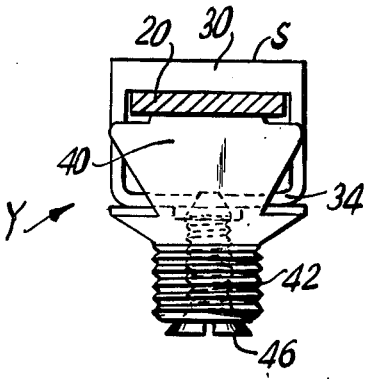
FIG. 9

FIG. 13
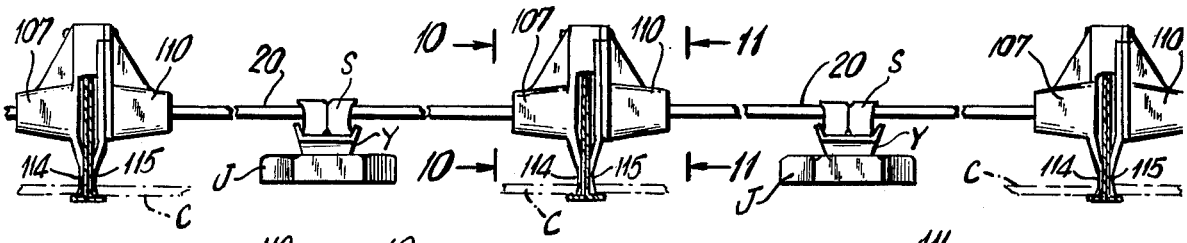
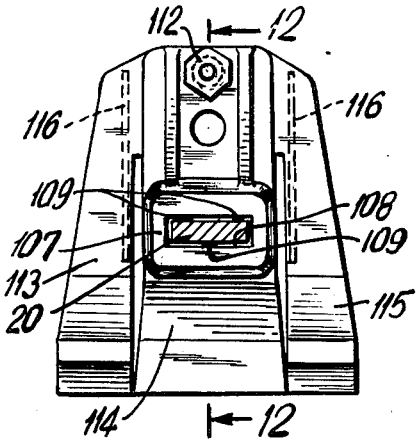
FIG. 10
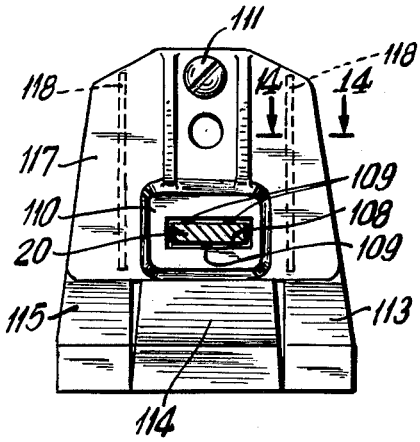
FIG. 11
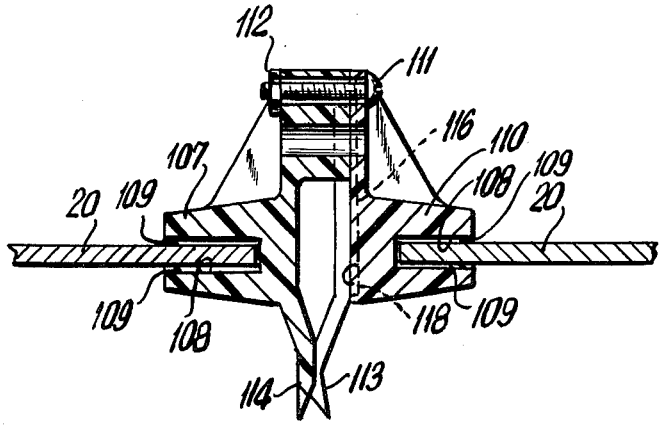
FIG. 12
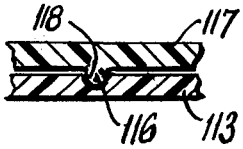
FIG. 14

FIXTURE HANGING ASSEMBLY

Cross-Reference to Related Applications

This application is a continuation-in-part of U.S. Ser. No. 715,822 filed on Aug. 19, 1976, which, in turn, is a continuation-in-part of U.S. Ser. No. 455,575, filed Mar. 28, 1974, now abandoned.

BACKGROUND OF THE INVENTION

The present invention relates to supports employed primarily in overhead structures such as suspended ceilings in the integration of ancillary lighting, ventilation, smoke detection, speakers, signs, alarms, auxiliary lighting and like equipment into the ceiling.

Under current construction procedures, an interior ceiling of substantial area may be connected to an overhead roof or roof superstructure, the interior ceiling being generally known as a "suspended" ceiling. In such a ceiling, it has been found necessary and/or desirable to incorporate lighting or ventilating or like systems of various types, including upwardly speced or coved lighting or ventilating means.

It is a basic objective of the present invention to supply improved supporting means for the incorporation of the illumination or ventilation means into a ceiling, the supports being of a construction and assembly such that the system is fully compatible with available structural materials for the construction of suspended ceilings. The fixture housings contain apparatus such as lighting equipment which is retained in such manner that bulbs and other portions requiring maintenance or replacement are readily accessible from below.

The invention has primary relation to these grid-types of suspended ceilings presently in vogue in modern public buildings, shopping centers, apartments and the like and is directed to means for facilitating the installation of a junction box or lighting fixtures, smoke detector, etc., capable of supporting such as a lighting fixture or device, or other article, which fixture or device or article frequently is of considerable weight. Typically up to about 30 lbs. can be supported by a single hanger strap before center deflection.

The insertable and removable ceiling panel is hardly dependable for supporting a heavy fixture or device or article, same being commonly a flush mounted or recessed type of fixture located at any desired position in a selected ceiling panel. The choice and type of fixture or device or article available for use with a suspended ceiling is normally limited accordingly.

SUMMARY OF THE INVENTION

Therefore, one object of this invention is to allow the adoption and use of an unlimited choice of fixtures or devices or articles with respect to shape, size or design in a range from simple low-priced to expensive high-priced types and with a minimum of concern as to weight.

A further object resides in the provisions of supports of standard modular dimension having new and novel bracket means whereby the supports and appurtenant apparatus are readily substituted for existing modules.

Yet another object is to provide a support for such a fixture as aforesaid wherein the fixture is easily maintained, is readily accessible from the underside for cleaning, repair or replacement of components, and may be used either with or without shields, diffusers, or other accessories.

An additional object of importance pertains to the construction and assembly of supports of this type from standard stock, with the result that the supports are non-complex in construction and assembly, inexpensive in manufacture, and durable in use.

Still another object of the present invention relates to providing a preferred supporting means which is safer, especially from the standpoint of electrical isolation, than supporting means provided heretofore.

A further object is to provide such means adapted to be anchored to the ceiling above the T-bar network.

A still further object of this invention is to provide a supporting means which is selectively adjustable in height.

An even further object of this invention is to provide a supporting means which allows for the installation of a continuous row of fixtures.

The concept of providing means in a suspended ceiling framework to offer adequate support means for fixtures or devices or articles is hardly new, but this invention, structurally, functionally and otherwise, improves upon known prior art support means, involves features which are new and novel, and provides a suspension unit which is an advancement over the art.

The concept relates to a prefabricated adaptor unit which includes a single, rigid, straight hanger strap in the form of a supporting bar of a predetermined length proportional to the space anticipated to be bridged, which hanger strap serves to accommodate a slotted fixture stud for the threaded engagement with and support of a conventional type of junction box. For the purposes of supporting devices other than conventional junction boxes, such as recessed fixtures, audio speakers, smoke detectors, and the like, the hanger strap serves to accommodate U-shaped mounting brackets in lieu of a threaded fixture stud. The respective end portions of the hanger strap are provided with clips or mounts, each consisting of a horizontal part adapted to be associated with a distal end portion of the hanger strap integral with a right-angularly-disposed downwardly-opening terminal end part defining a strap mounting and attaching means, which means is slip-fitted over opposite sides of the vertical flange of the T-iron employed in the ceiling frame.

In other words, the hanger strap is of a requisite length and straight from end to end and serves to accommodate the conventional junction box, or other fixture, such as a recessed fixture, a speaker, smoke detectors, exit signs, etc., the support means being either in the form of a fixture stud which is slotted so as to be slidingly received over and along the hanger strap in a manner to permit the junction box to be shifted so as to assume and maintain any selected situs relative to the ceiling and of course relative to the room, or other means, such as a U-shaped mounting bracket adapted to be clipped on the hanger strap and further adapted to be fastened by a screw to the appropriate fixture or other device. A straight hanger strap, in contrast to the prior art U-shaped strap, gives versatility with most types of recessed fixtures.

Other and further objects and advantages will become apparent to those skilled in the art from a consideration of the following specification when read in conjunction with the annexed drawings in which:

BRIEF DESCRIPTION OF THE DRAWINGS

FIG. 2 is a perspective view showing a hanger strap with free distal ends and having clipped thereon a mounting bracket used in connection with this invention;

FIG. 3 is a side view of the mounting bracket shown in FIG. 2 and a side view of a sheet metal screw used in connection therewith;

FIG. 8 is an exploded view of a conventional fixture stud used in connection with the invention;

FIG. 9 is an assembled view of the FIG. 8 fixture stud;

FIG. 10 is a front elevational view of another improved form of the clip or mount of this invention viewed along line 10—10 in FIG. 13;

FIG. 11 is a rear elevational view of the FIG. 10 clip or mount viewed along line 11—11 in FIG. 13;

FIG. 12 is a side sectional view of the clip or mount taken along line 12—12 of FIG. 10 and showing the insertion of one distal end of a pair of hanger straps;

FIG. 13 is a side view of the improved clip or mount of FIG. 10 showing the insertion of the distal ends of several hanger straps and also showing the installation of a continuous row of fixtures according to this invention;

FIG. 14 shows the tongue and groove back to back relationship of horizontal components 107 and 110 taken along line line 14—14 in FIG. 11;

DETAILED DESCRIPTION OF THE INVENTION

Figures 1, 4, 5, 6, 7:
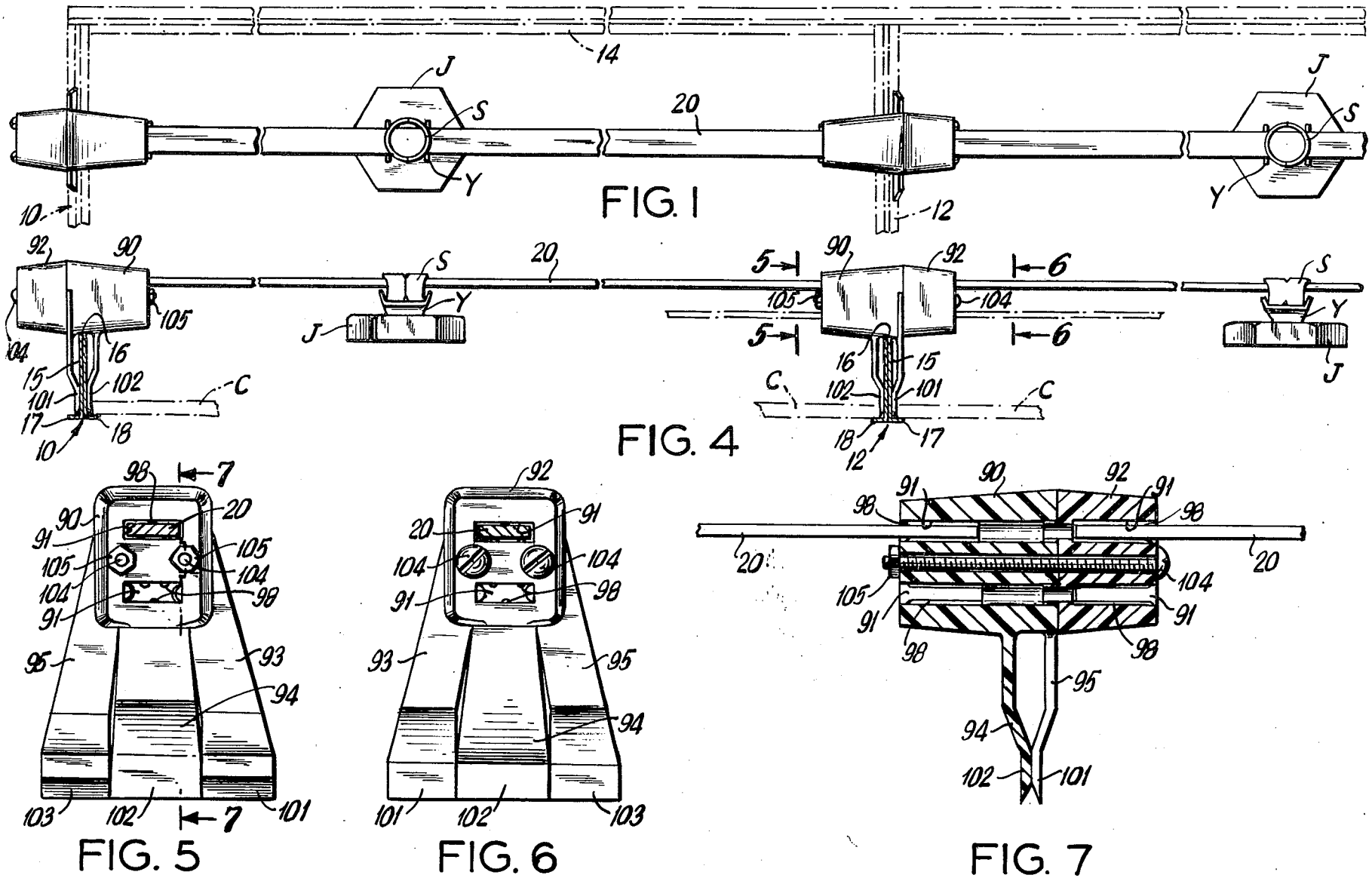
FIG. 1 is a top plan view of a portion of suspended ceiling construction with a support yoke of the instant invention in use therewith and showing the installation of a continuous row of fixtures.
FIG. 4 is a side perspective view of FIG. 1 with certain parts broken away or in section for clarity.
FIG. 5 is a front elevational view of the improved form of clip or mount of this invention.
FIG. 6 is a rear elevational view of the FIG. 5 clip or mount.
FIG. 7 is a side section view taken along line 7—7 of the clip or mount of FIG. 5 showing the insertion of one distal end of a pair of hanger straps.

Proceeding to a more detailed description of the invention and referring initially to the forms shown in FIGS. 1 and 4, the support assembly and ceiling construction hereof includes at least one pair of spaced apart parallel coplanar longitudinal rail members 10 and 12 and a transverse rail member 14. The rail members are of inverted T shape and have upstanding legs 15 with a bead 16 and distal and proximal ledges 17 and 18. The rail members are suspended in a grid arrangement from some overhead anchorage such as a roof or roof beams (not shown) by such as hanger cables or the like engaged in provided openings through the leg below the bead.

Horizontally arranged blocks C of interior ceiling material, such as acoustical tile or the like, are suspended on the ledges 17 and 18 of the rail members. The blocks C thus form an interior ceiling disposed in a given substantially horizontal plane.

So much as has been above described comprises known standard equipment. Accordingly, the supporting assembly hereof is readily employed in existing structures.

The usual outlet box J is adapted to be supported from hanger strap 20 by a fixture stud in the following manner, particularly referring to FIGS. 1, 4, 8 and 9:

A plug S includes a slot 32 to define an upper or top wall 30 which rides on top of the hanger strap as the hanger strap is extended through the slot 32 and a lower or bottom wall 34 which has a threaded aperture 36 centrally therethrough.

The hanger strap is adjustably extended relative to the fixture stud as is clearly evident in FIGS. 1 and 4. That is, the hanger strap serves to accommodatingly and adjustably support the fixture stud and its assodiated junction box J.

The fixture stud also includes a retaining yoke Y which includes an upwardly projecting tongue 40 unitary with a lowermost externally threaded bulbous portion 42 having a through opening 44 extending therethrough.

A set screw 46 extendable through aperture 44 is threadedly engageable with the thread in aperture 36 so as to bring the topmost planar surface of retaining yoke 40 into snug embracement with the underside of the hanger or strap as shown in FIG. 9 so as to make a tight hanger strap-fixture stud relationship.

The fixture hanging junction box is threadedly mounted on the threaded end of annular portion 42 and is accordingly held against rotary movement.

The junction box can be easily slid freely along the length of the hanger strap and can be secured by tightening set screw 46 at any selected position. This feature provides adjustability in the placing and centering of the fixture box. A hole is then made on the ceiling panel directly below where the box is secured and the fixture (not shown) is eventually hung therefrom.

FIGS. 2 and 3 represent an alternative mode to support a device from hanger strap 20 by use of a U-shaped mounting bracket 98 which is adapted to be snugly clipped onto the hanger strap 20. The mounting bracket 98 is adapted to receive a screw 99, such as a sheet metal screw, through aperture 100, to be further received by the open threaded portion of the appropriate fixture or device to be supported. In the practice of the present invention one or more of these mounting brackets 98 are contemplated.

The hanging fixture cannot be pushed upwards or out of place because the junction box is secured on the hanger strap which in turn is secured at both ends to the T-irons by means to be disclosed. Thus, the fixture is virtually immovable despite the fact that the ceiling panels can be pushed out of place in the usual manner by as little effort as a touch of the finger.

A plurality of yoke assemblies or adapter units is provided for extending between in bridging manner selected pairs of longitudinal rails 10 and 12 for the mounting of the upwardly spaced equipment.

FIGS. 5–7 and 10–12 are exemplifications of the improved clips or mounts within the scope of this invention. It is understood that the clips or mounts of FIGS. 5–7 and 10–12 are preferentially formed of a plastic material, most preferably a flame-resistant plastic material. Particularly preferred plastic materials include polyacetals, such as Delrin, available from duPont, and Celcon, available from the Celanese Corp. Most especially preferred materials are plastics having what is known as a plastic memory, i.e., one that always returns to its originally molded shape. However, while not particularly preferred, the improved clips or mounts of this invention may also be made of suitable metal.

Referring to FIGS. 5–7, a horizontally-extending component 90 will be observed to be of a thickness and width as to allow formation therein of at least one, and preferably, a plurality of open-ended pockets 91 (two pockets are shown for exemplary purposes), each capable of receiving the free distal end of a hanger strap. To insure a snug friction fit with the end of the hanger strap, and to accommodate possible slight variations in the thickness of the hanger strap, the open-ended pockets 91 can be provided with ribs 98 extending lengthwise in the pocket. By virtue of providing a plurality of open-ended pockets 91, the supporting means of this invention is accordingly selectively adjustable in height providing the user thereof with a choice of heights to use in order to suitably accommodate the particular fixture with which he is working. For example, by inserting a free end of the hanger strap in the lower of the open-ended pockets of the clips or mounts, the fixture will hang lower than if the free end of the hanger strap is inserted in the higher open-ended pockets. Similarly, if the free end of the hanger strap is inserted in the higher of the open-ended pockets, the fixture will hang higher.

As illustrated by FIG. 7, horizontally-extending component 92 is joined in a back to back relationship and affixed to horizontally-extending component 90 by threaded bolts 104 and affixing nuts 105. While not shown, other means of affixing horizontal components 90 and 92 to each other are contemplated, such means including, for example, using a sheet metal screw in place of threaded bolt 104 and a snap fitting lock in place of affixing nut 105. Similar to horizontal component 90, horizontal component 92 is also of a sufficient thickness and width to allow formation therein of at least one, and preferably a plurality of open-ended pockets 91 (two pockets are shown for exemplary purposes), each capable of receiving a free distal end of a hanger strap. As a result of the open-ended pockets in each of the horizontal components 90 and 92, and the fact that horizontal components 90 and 92 are affixed back to back, as illustrated, the clips or mounts of this invention permit the installation of a continuous row of fixtures as shown, for example, in FIGS. 1 and 13.

Depending downwardly from the horizontal component 90, at one end thereof, are a trio of spaced flexible legs 93, 94 and 95. The outer legs 93 and 95 and the inner leg 94 are, in this embodiment, preferably all of a length permitting them to terminate at the same distance below the top of the T-bar. However, it is also contemplated by this invention to provide that our legs 93 and 95 are shorter than inner leg 94. In either case, the outer legs 93 and 95 are capable of being flexed into a position over the bead 16 and against the inboard face of an upstanding leg 15 of a T-bar rail member whereby the bottom edges of the legs may be brought to rest upon or at any strategic location above the proximal ledge 18 and the lag 94 representing the inner leg is capable of being flexed into a position over the bead 16 and against the outboard face of the leg 15 of the rail member whereby the bottom edge of the leg may be brought to rest upon the distal ledge 17.

As is further shown in FIGS. 5–7, each of legs 93, 94 and 95 terminates at its bottom end in tapered portions 101, 102 and 103, respectively. These are adapted to facilitate easy installation of the clip. In contrast to the earlier embodiments which do not have such tapered portions, merely forcing the clip into engagement with the top of the T-bar provides cooperation with each said tapered portion to automatically urge the legs apart and into proper engaging alignment.

Figure 15:
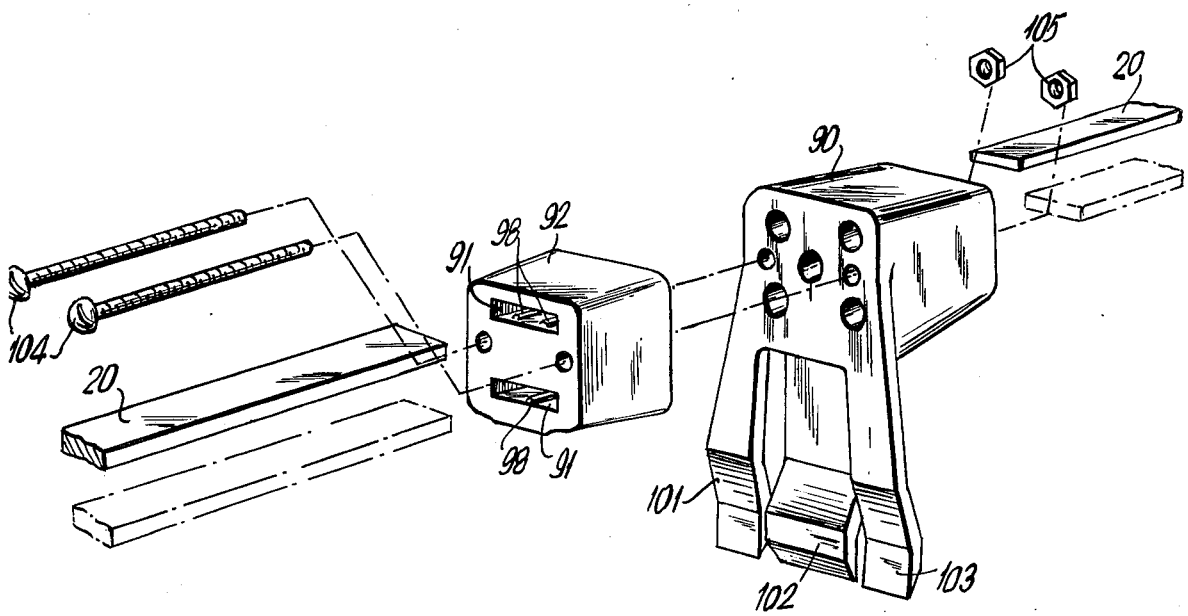
FIG. 15 is an exploded view in perspective of the improved clip of FIGS. 5–7.

FIG. 15 illustrates the assembly of the improved clip of FIGS. 5–7, also depicting the insertion of hanger straps in the open-ended pockets allowing for the installation of a continuous row of fixtures.

With reference to FIGS. 10–13, a horizontally-extending component 109 will be observed to be of a thickness and width so as to allow formation therein of at least one open-ended pocket 108 (one pocket is shown for exemplary purposes) capable of receiving a free distal end of a hanger strap. To insure a snug friction fit with the end of the hanger strap, and to accommodate possible slight variations in the thickness of the hanger strap, the open-ended pocket 108 can be provided with ribs 109 extending lengthwise in the pocket.

Horizontally-extending component 110 is joined and affixed to horizontally-extending component 107 by threaded bolt 111 and affixing nuts 112. As with the clip or mount of FIGS. 5–7, other means of affixing horizontal components 107 and 110 are contemplated herein, such as described hereinabove. Similar to horizontal component 107, horizontal component 110 is also of a sufficient thickness and width to allow formation therein of at least one open-ended pocket 108 (one pocket is shown for exemplary purposes), capable of receiving the free distal end of a hanger strap. As a result of the open-ended pockets in each of the horizontal components 107 and 110 affixed back to back as illustrated, the clips or mounts of this invention permit the installation of a continuous row of fixtures as shown, for example, in FIG. 13. As illustrated by FIGS. 10–14, outside legs 113 and 115 which are in communication with horizontal component 107 are each provided with, e.g., in a one-piece molded fashion, a longitudinal extending tongue member 116, while the back plate 117 of horizontal component 110 is provided with longitudinal grooves to accept tongues 116 and to further insure a snug back to back relationship of horizontal components 107 and 110.

Depending downwardly from and in communication with the horizontal component 107, at one end thereof, are a trio of spaced flexible legs 113, 114 and 115. The outer legs 113 and 115 and the inner leg 114 are, in this embodiment, preferably all of a length permitting them to terminate at the same distance below the top of the T-bar. However, it is also contemplated by this invention to provide that outer legs 113 and 115 are shorter than inner leg 114. In either case, the outer legs 113 and 115 are capable of being flexed into a position over the bead 16 and against the inboard face of an upstanding leg 15 of a T-bar rail member whereby the bottom edges of the legs may be brought to rest upon or at any srategic location above the proximal ledge 18 and the leg 114 representing the inner leg is capable of being flexed into a position over the bead 16 and against the outboard face of the leg 15 of the rail member whereby the bottom edge of the leg may be brought to rest upon the distal ledge 17.

As is further shown in FIGS. 10–12, each of legs 113, 114 and 115 terminates at its bottom and in tapered positions 116, 117 and 118, respectively. These are adapted to facilitate easy installation of the clip.

Figure 16:
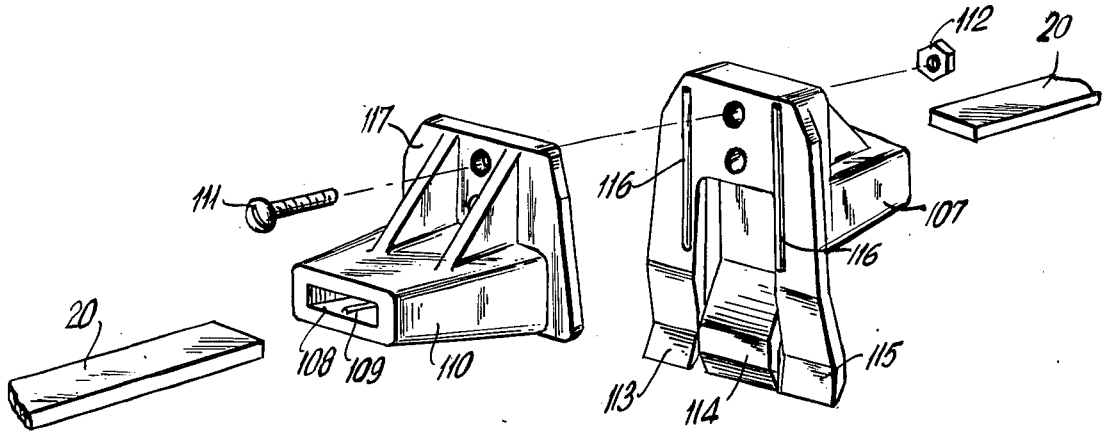
FIG. 16 is an exploded view in perspective of the improved clip of FIGS. 10–12.

FIG. 16 illustrates the assembly of the improved clips of FIGS. 10–12, also depicting the insertion of hanger straps in the open-ended pockets allowing for the installation of a continuous row of fixtures.

In addition to their other advantages, the clips or mounts of the present invention made of plastic, provide safeguards against shorted fixtures and accidentally energized metal frameworks as a result of the electrically insulating properties of the plastic. Obviously, electrically insulating materials other than plastic are also contemplated herein for this purpose.

While we have illustrated and described a preferred and modified form of construction for carrying our invention into effect, the same are capable of variation and modification, without departing from the spirit of the invention. We, therefore, do not wish to be limited to the precise details of construction set forth but desire to avail ourselves of such variations and modifications as come within the scope of the appended claims.

Having thus described our invention, what we claim as new and desire to protect by Letters Patent is:

1. In combination with an open work grid type suspended ceiling frame construction incorporating ceiling blocks supported by pairs of spaced interconnected inverted T-bars, a fixture hanging support for bridging the space between a pair of adjacent T-bars and including:

(i) at least two elongated flat hanger straps each having free opposite distal end portions;

(ii) at least three clips or mounts each engageable with one of the distal end portions of the hanger strap and having a downwardly depending T-bar engaging portion comprising a trio of spaced resilient legs with the pair of outside legs being embraceable with one side of the T-bar and the intermediate leg being embraceable with the opposite side of the T-bar, the outside and inside legs terminating at the same distance below the top of the T-bar, having a first horizontally extending component in communication with said trio of legs and a second horizontally extending component in communication with said first horizontally extending component, said first and second horizontally extending components each provided with at least one open-ended pocket adapted to receive a free distal end of said hanger strap.

2. The article of claim 1 wherein said clips or mounts are constructed of plastic.

3. The article of claim 2 wherein said clips or mounts are constructed of flame-resistant plastic.

4. A fixture hanging support for bridging the space between a pair of adjacent T-bars in a suspended ceiling frame construction, said support comprising (i) at least two elongated flat hanger straps, each having free opposite distal end portions;

(ii) at least three clips or mounts each engageable with one of the distal end portions of the hanger strap and having a downwardly depending T-bar engaging portion comprising a trio of spaced legs with the pair of outside legs being embraceable with one side of the T-bar and the intermediate leg being embraceable with the opposite side of the T-bar, having a first horizontally extending component in communication with said trio of legs and a second horizontally extending component in communication with said first horizontally extending component, said first and second horizontally extending components each provided with at least one open-ended pocket adapted to receive a free distal end of said hanger strap.

5. The fixture hanging support of claim 4 wherein said clips or mounts are constructed of plastic.

6. The fixture hanging support of claim 5 wherein said plastic is flame-resistant.

7. A clip or mount adapted to engage a free distal end portion of an elongated flat hanger strap in a fixture hanging support construction for bridging the space between a pair of adjacent T-bars in a suspended ceiling frame, said clip or mount comprising a first horizontally extending component in communication with a trio of spaced resilient legs with the pair of outside legs being adapted to embrace one side of a T-bar and the intermediate leg being adapted to embrace the opposite side of the T-bar, and a second horizontally extending component in communication with said first horizontally extending component, said first and second horizontally extending components each being provided with at least one open-ended pocket adapted to receive a free distal end of said hanger strap.

8. A clip or mount as defined in claim 7 constructed of plastic.

9. A clip or mount as defined in claim 8 wherein said plastic is flame resistant.

10. A clip or mount as defined in claim 7 wherein said first and second horizontally extending components are provided with a plurality of said open-ended pockets.

11. A clip or mount as defined in claim 7 wherein each of the legs terminates at its bottom end in a tapered portion whereby forcing the clip into engagement with the top of the T-bar cooperates with each said tapered portion to automatically urge the legs apart and into proper engaging alignment.

12. A clip or mount as defined in claim 11 constructed of plastic.

13. A clip or mount as defined in claim 12 wherein said plastic is flame-resistant.

14. A clip or mount as defined in claim 8 wherein said plastic has a plastic memory.

15. A clip or mount as defined in claim 12 wherein said plastic has a plastic memory.

* * * * *